US008801120B2

(12) United States Patent
Chen et al.

(10) Patent No.: US 8,801,120 B2
(45) Date of Patent: Aug. 12, 2014

(54) SELF-OPENING AND SELF-CLOSING SLIDE ASSEMBLY

(75) Inventors: Ken-Ching Chen, Kaohsiung (TW); Yi-Syuan Jhao, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 147 days.

(21) Appl. No.: 13/611,442

(22) Filed: Sep. 12, 2012

(65) Prior Publication Data

US 2014/0072248 A1 Mar. 13, 2014

(51) Int. Cl.
*A47B 95/00* (2006.01)

(52) U.S. Cl.
USPC ..... 312/333

(58) Field of Classification Search
CPC ..... A47B 88/0481; A47B 88/047
USPC ..... 312/333
See application file for complete search history.

(56) References Cited

U.S. PATENT DOCUMENTS 3,854,785 A * 12/1974 Manner et al. ..... 312/319.1
7,084,345 B1 * 8/2006 Chen et al. ..... 174/545
7,249,813 B2 7/2007 Gasser
7,374,261 B1 5/2008 Wang
8,172,345 B2 5/2012 Liang et al.
2006/0017358 A1 * 1/2006 Sato et al. ..... 312/333
2009/0273263 A1 11/2009 Berger
2010/0164340 A1 * 7/2010 Juan et al. ..... 312/333
2010/0293746 A1 * 11/2010 Johansson et al. ..... 16/85
2011/0012488 A1 * 1/2011 Liang et al. ..... 312/319.1
2011/0156561 A1 * 6/2011 Salice ..... 312/319.1
2014/0021841 A1 * 1/2014 Brunnmayr ..... 312/319.1

FOREIGN PATENT DOCUMENTS

WO WO2010/066393 A1 6/2010

* cited by examiner

*Primary Examiner* — Darnell Jayne
*Assistant Examiner* — Timothy M Ayres
(74) *Attorney, Agent, or Firm* — Rosenberg, Klein & Lee

(57) ABSTRACT

A self-opening and self-closing slide assembly includes a first rail, a second rail, a third rail, a movable unit, a hooking member and a contact member. The movable unit is installed to the first rail and includes a movable member, a first resilient member and a second resilient member. The second rail is installed between the first and third rails. The hooking member and the contact member are connected to the third rail. When the third rail is pushed, the hooking member is disengaged from the movable member. The second rail extends relative to the first rail by the force from the first resilient member. When the third rail is retracted relative to the first rail, the hooking member is connected to the movable member and the second resilient member applies a force the movable member to retract the third rail relative to the first rail.

10 Claims, 18 Drawing Sheets

SELF-OPENING AND SELF-CLOSING SLIDE ASSEMBLY

FIELD OF THE INVENTION

The present invention relates to a self-opening and self-closing device, and more particularly, to a self-opening and self-closing slide assembly that can be self-opening when being pressed and self-closing when being pushed inward.

BACKGROUND OF THE INVENTION

A conventional opening and closing device used for drawers is disclosed in U.S. Pat. No. 7,374,261 to Wang with the title of "Push-open type slide structure" and U.S. Pat. No. 7,249,813 to Gasser with the title of "Retraction device for drawers", both of which provide a single function.

U.S. Pat. No. 8,172,345 to Liang with the title of "Self-moving device for movable furniture parts" discloses a self-moving device for slide assembly.

The present invention intends to provide a self-close/open slide assembly which combines the functions of self-open and self-close so that the rails automatically open or close by applying a force thereto.

SUMMARY OF THE INVENTION

The present invention relates to a self-opening and self-closing slide assembly and comprises a first rail having a side wall, a release portion, a guide groove and a first passage. The release portion is located on the side wall and in the first passage. The guide groove is located on the side wall and has a longitudinal groove and a transverse groove which communicates with the longitudinal groove. A second rail is slidably connected to the first rail and has a side wall, a protrusion and a second passage. The protrusion is connected to the side wall of the second rail and faces the first passage of the first rail. A third rail is slidably connected to the second rail and has a push block facing the second passage of the second rail. A movable unit has a base, a first resilient member, a push member, a movable member and a second resilient member. The base is connected to the side wall of the first rail and has a longitudinal section, a room and a guide passage. The room is substantially parallel to the longitudinal section. The guide passage has a longitudinal guide groove and a transverse guide groove which communicates with the longitudinal guide groove. The first resilient member is biased between the base and the push member. The push member is located corresponding to the second rail. The movable member is movably connected to the base and has a first leg, a second leg, a guide path and an engaging portion. The first leg and the second leg are respectively located corresponding to the guide passage and the room of the base. The guide path has a first longitudinal guide path, a second longitudinal guide path and a mediate path. The first and second longitudinal guide paths are located on two sides of the engaging portion. The mediate path communicates with the first and second longitudinal guide paths and located corresponding to the engaging portion. The second resilient member is located in the room of the base and contacts the second leg of the movable member. A passive unit has a link, a connection unit and a first spring. The link has a first protrusion and a second protrusion. The first protrusion is located in the guide groove of the first rail and the second protrusion is located corresponding to the protrusion of the second rail. The connection unit is connected between the movable member and the link. The first spring is connected between the link and the connection unit.

A synchronic unit has a synchronic member and a second spring. The synchronic member is pivotably connected to the second rail and has a first contact portion and a second contact portion. The first contact portion faces the side wall of the first rail and is located corresponding to the release portion. The second contact portion is located corresponding to the push block of the third rail. The second spring is connected between the synchronic member and the second rail. A hooking unit has a hooking member and a contact member. The hooking member is pivotably connected to the third rail and has a hooking portion. The contact member is fixed to the third rail and located corresponding to the movable member. When the third rail is located at a retracted position relative to the first rail, the second rail is retracted in the first rail. The hooking portion of the hooking member is engaged with the engaging portion of the movable member. The push member is pushed by the second rail and compresses the first resilient member. The first resilient member generates a force in a first direction and the force is applied to the push member. The second leg of the movable member contacts the second resilient member. The push block of the third rail is located corresponding to the second contact portion of the synchronic member. When the third rail is pushed by a pushing force, the hooking portion of the hooking member is disengaged from the engaging portion of the movable member and is moved to the first longitudinal guide path of the movable member. When the pushing force is disappeared, the force in the first direction of the first resilient member is released. The second rail is pushed by the push member and moves relative to the first rail. When the third rail is continuously pulled, the push block of the third rail contacts the second contact portion of the synchronic member so that the second rail is pulled along with the movement of the third rail. The protrusion of the second rail pushes the second protrusion of the link so that the first protrusion of the link moves along the longitudinal groove of the guide groove of the first rail. The movable member is moved by the link and the connection unit. The movable member moves along the longitudinal guide groove of the guide passage of the base. When the first protrusion is engaged with the transverse groove of the guide groove, the protrusion of the second rail presses on a top of the second protrusion of the link. The first leg is located in the transverse guide groove of the guide passage and the second resilient member is compressed by the second leg and generates a force in a second direction. When the first contact portion of the synchronic member contacts the release portion of the first rail, the synchronic member swings an angle and the second contact portion of the synchronic member is disengaged from the push block of the third rail. When the third rail is retracted relative to the first rail, the first contact portion of the synchronic member is separated from the release portion of the first rail and the second contact portion returns to a position located corresponding to the push block. When the contact member pushes the movable member, the movable member is disengaged from the transverse guide groove of the guide passage and the hooking portion of the hooking member contacts the engaging portion of the movable member. The force of the second resilient member retracts the third rail relative to the first rail and the first protrusion or the link is separated from the transverse groove of the guide groove.

Preferably, the slide assembly further comprises a threaded block and an adjustment member, and both of which are located corresponding to the room. The adjustment member has a threaded rod and a head which extends from one end of the threaded rod. The threaded rod of the adjustment member threadedly extends through the threaded block. The threaded rod in the room contacts the second leg of the movable member.

Preferably, the connection unit comprises a first connector and a second connector which is connected to the first connector. The first connector is fixed to the movable member by a fixing member. The second connector is pivotably connected to the link.

Preferably, the link has a first hook and the second connector has a second hook. The first spring is hooked between the first and second hooks.

Preferably, a support member is fixed to the side wall of the first rail and has a support passage in which the second connector is movably located. The support member has at least one stop wall to maintain the second connector in the support passage.

Preferably, the side wall of the second rail has a window and the synchronic member is located beside the window and pivotably connected to the second rail by a pivot. The first contact portion of the synchronic member extends through the window and toward the side wall of the first rail.

Preferably, the first contact portion of the synchronic member has an inclined face which is located corresponding to the release portion of the first rail. The synchronic member has a third hook and the second rail has a fourth hook. The second spring is hooked between the third and fourth hooks.

Preferably, the third rail has an opening. The hooking unit comprises a cover which is located corresponding to the opening and is fixed to the third rail. The hooking member is pivotably connected to the cover by a pin. The cover has a curved slot which is located corresponding to the hooking portion of the hooking member. The hooking portion of the hooking member extends through the curved slot.

Preferably, the first rail has a buffering member connected thereto and comprises a plunger which is extendable from the buffering member. The distance that the plunger extends forms a buffering travel to the second rail.

Alternatively, the present invention also provides a self-close/open slide assembly and comprises a first rail having a top wall, bottom wall, a side wall, a release portion and a guide groove. The side wall is connected between the top and bottom walls. The top wall, the bottom wall and the side wall define a first passage. The release portion is located on the side wall and in the first passage. The guide groove is located on the side wall and has a longitudinal groove and a transverse groove which is located at the distal end of the longitudinal groove and communicates with the longitudinal groove. A second rail is slidably connected to the first rail and has a top wall, a bottom wall, a side wall and a protrusion. The side wall is connected between the top and bottom walls of the second rail. The top wall, the bottom wall and the side wall define a second passage. The protrusion is connected to the side wall of the second rail and faces the first passage of the first rail. A third rail is slidably connected to the second rail and has a push block facing the second passage of the second rail. A movable unit has a base, a fixing frame, a first resilient member, a push member, a movable member and a second resilient member. The base is connected to the side wall of the first rail and has a longitudinal section, a room and a guide passage. The room is substantially parallel to the longitudinal section. The guide passage has a longitudinal guide groove and a transverse guide groove which is located at the distal end of the longitudinal guide rove and communicates with the longitudinal guide groove. The fixing frame is connected to the base and comprises a longitudinal rod. The first resilient member is mounted to the longitudinal rod. The push member is slidably connected to the longitudinal section of the base and movably mounted to the longitudinal rod of the fixing frame and contacts the first resilient member. The movable member is movably connected to the base and has a first leg, a second leg, a guide path and an engaging portion. The first leg and the second leg are respectively located corresponding to the guide passage and the room of the base. The guide path has a first longitudinal guide path, a second longitudinal guide path and a mediate path. The first and second longitudinal guide paths are located on two sides of the engaging portion. The mediate path communicates with the first and second longitudinal guide paths and is located corresponding to the engaging portion. The second resilient member is located in the room of the base and contacts the second leg of the movable member. A passive unit has a link, a connection unit and a first spring. The link has a first protrusion and a second protrusion. The first protrusion is located in the guide groove of the first rail and the second protrusion is located corresponding to the protrusion of the second rail. The connection unit is connected between the movable member and the link. The first spring is connected between the link and the connection unit. A synchronic unit has a synchronic member and a second spring. The synchronic member is pivotably connected to the second rail and has a first contact portion and a second contact portion. The first contact portion faces the side wall of the first rail and is located corresponding to the release portion. The second contact portion is located corresponding to the push block of the third rail. The second spring is connected between the synchronic member and the second rail. A hooking unit has a hooking member and a contact member. The hooking member is pivotably connected to the third rail and has a hooking portion. The contact member is fixed to the third rail and located corresponding to the movable member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
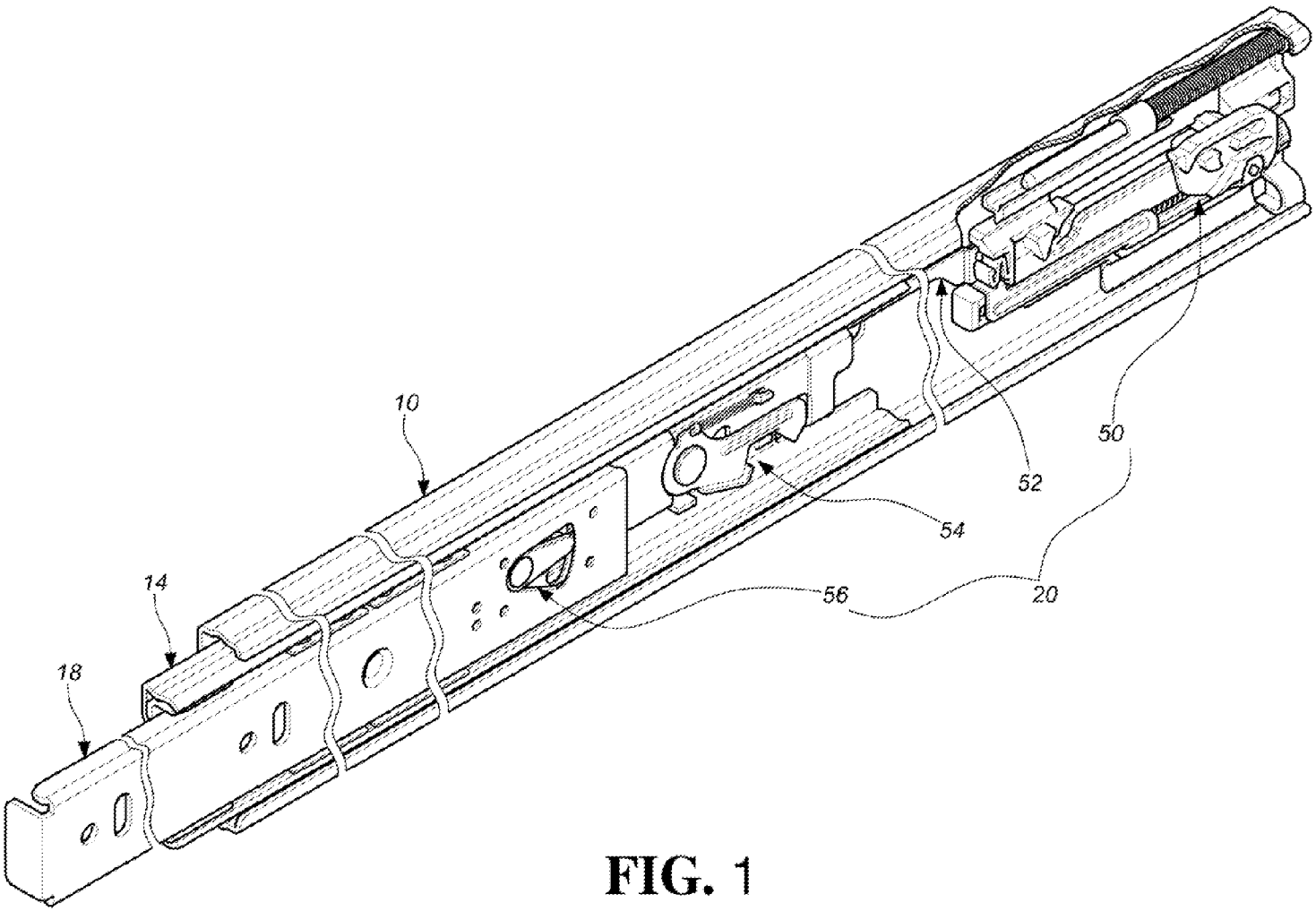
FIG. 1 is a perspective view to show the slide assembly of the present invention.
Figure 2:
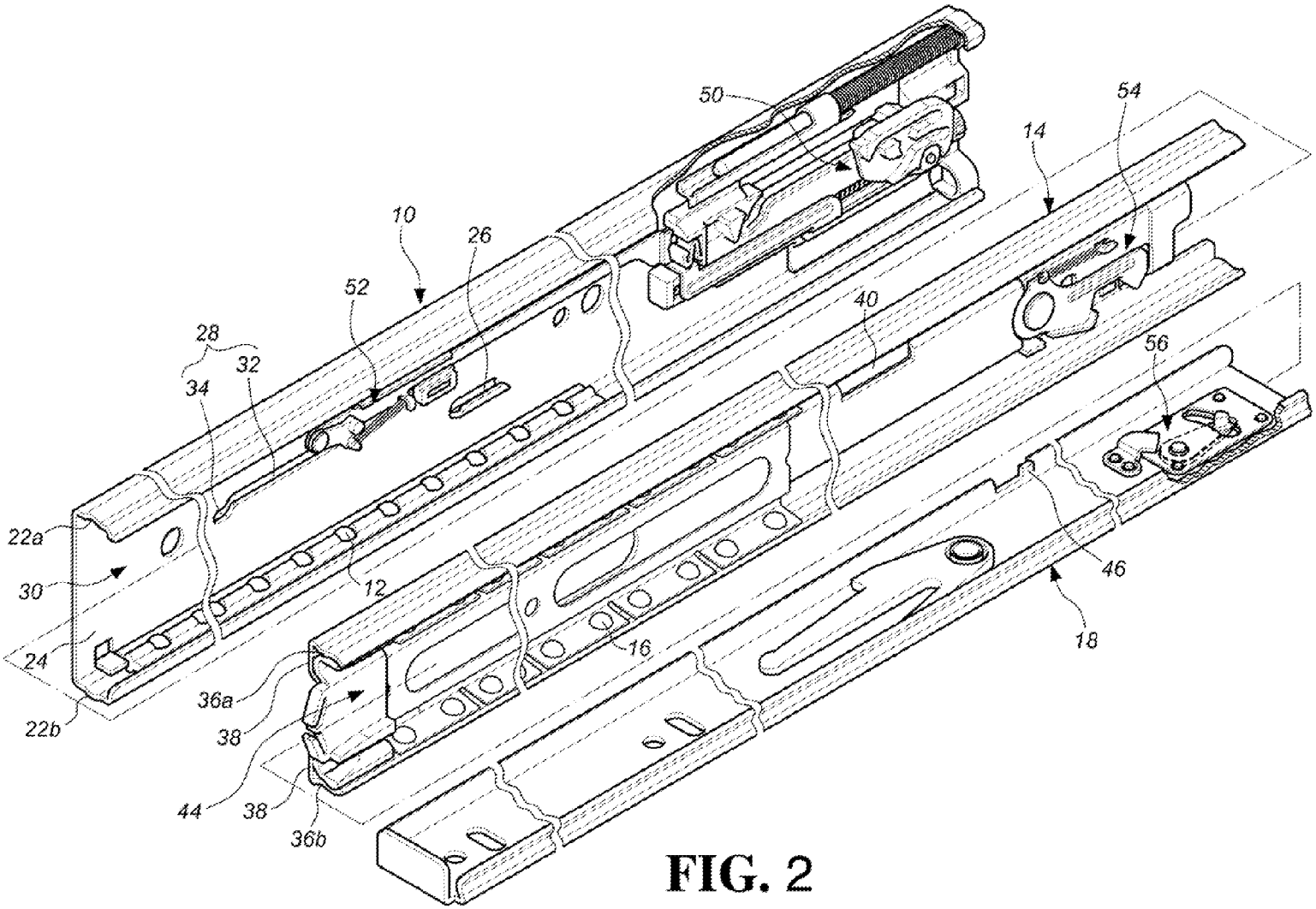
FIG. 2 is an exploded view to show the slide assembly of the present invention.

Referring to FIGS. 1 and 2, the self-opening and self-closing slide assembly of the present invention comprises a first rail 10, a first bearing assembly 12, a second rail 14, a second bearing assembly 16, a third rail 18 and an open-close device 20. The first bearing assembly 12 is connected to the first rail 10 so that the second rail 14 is slidably connected to the first rail 10. The second bearing assembly 16 is connected to the second rail 14 so that the third rail 18 is slidably connected to the second rail 14.

The first rail 10 has a top wall 22*a*, bottom wall 22*b*, a side wall 24, a release portion 26 and a guide groove 28. The side wall 24 is connected between the top and bottom walls 22*a*, 22*b*. The top wall 22*a*, the bottom wall 22*b* and the side wall 24 define a first passage 30. The release portion 26 is located on the side wall 24 and in the first passage 30. The guide groove 28 is located on the side wall 24 and has a longitudinal groove 32 and a transverse groove 34 which is located at the distal end of the longitudinal groove 32 and communicates with the longitudinal groove 32.

Figure 3:
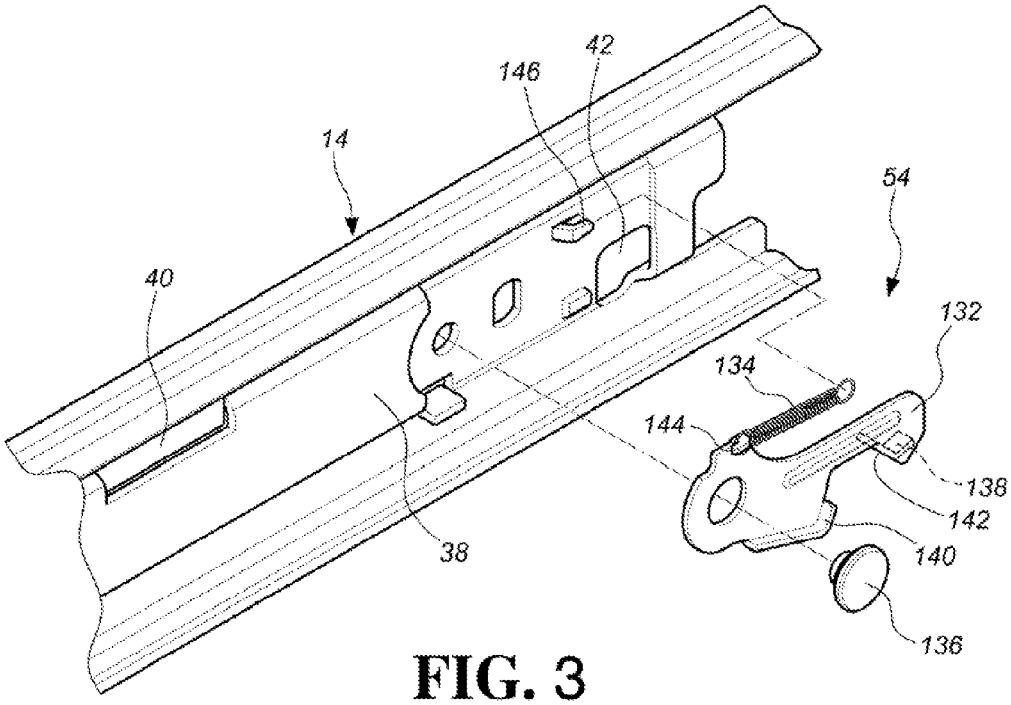
FIG. 3 is an exploded view to show the synchronic unit of the slide assembly of the present invention.

The second rail 14 is slidably connected to the first passage 30 of the first rail 10 by the first bearing assembly 12. The second rail 14 comprises a top wall 36*a*, a bottom wall 36*b*, a side wall 38, a protrusion 40 and a window 42 as shown in FIG. 3. The side wall 38 is connected between the top and bottom walls 36*a*, 36*b* of the second rail 14. The top all 36*a*, the bottom all 36*b* and the side wall 38 define a second passage 44. The protrusion 40 is connected to the side wall 38 of the second rail 14 and faces the first passage 30 of the first rail 10. The window 42 is defined in an end of the side wall 38.

Figure 4:
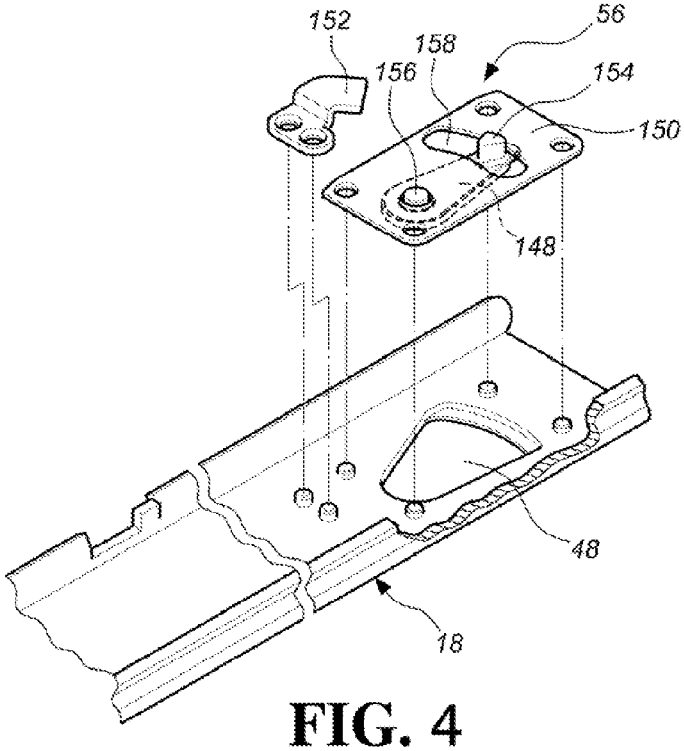
FIG. 4 is an exploded view to show the hooking unit of the slide assembly of the present invention.

The third rail 18 is slidably connected to the second passage 44 of the second rail 14 by the second bearing assembly 16, and has a push block 46 and an opening 48 as shown in FIG. 4. The push block 46 faces the second passage 44 of the second rail 14.

The open-close device 20 comprises a movable unit 50, a passive unit 52, a synchronic unit 54 and a hooking unit 56.

Figure 5:
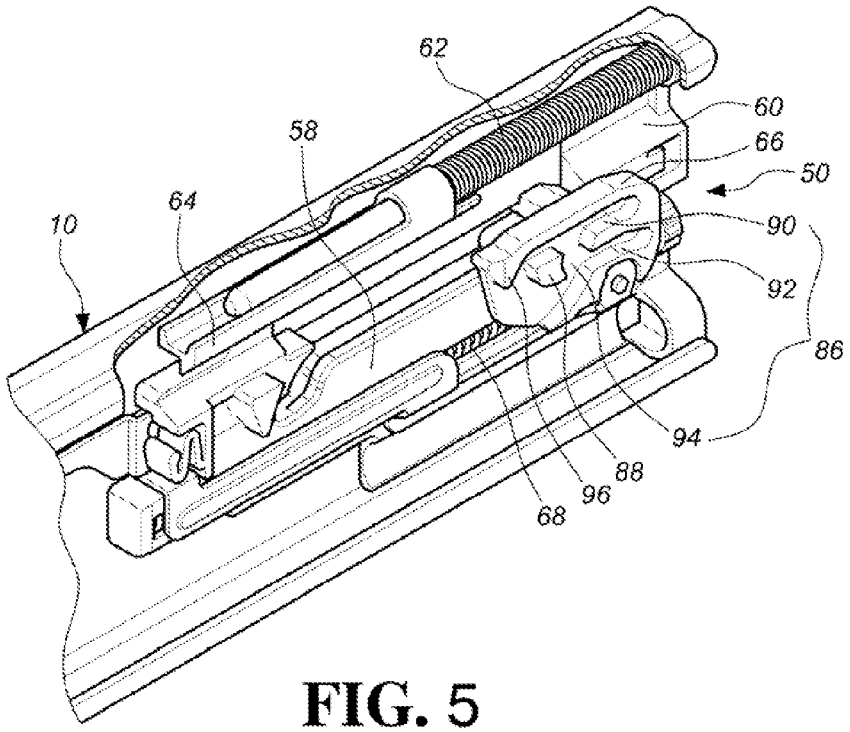
FIG. 5 is an exploded view to show the movable unit of the slide assembly of the present invention.
Figure 6:
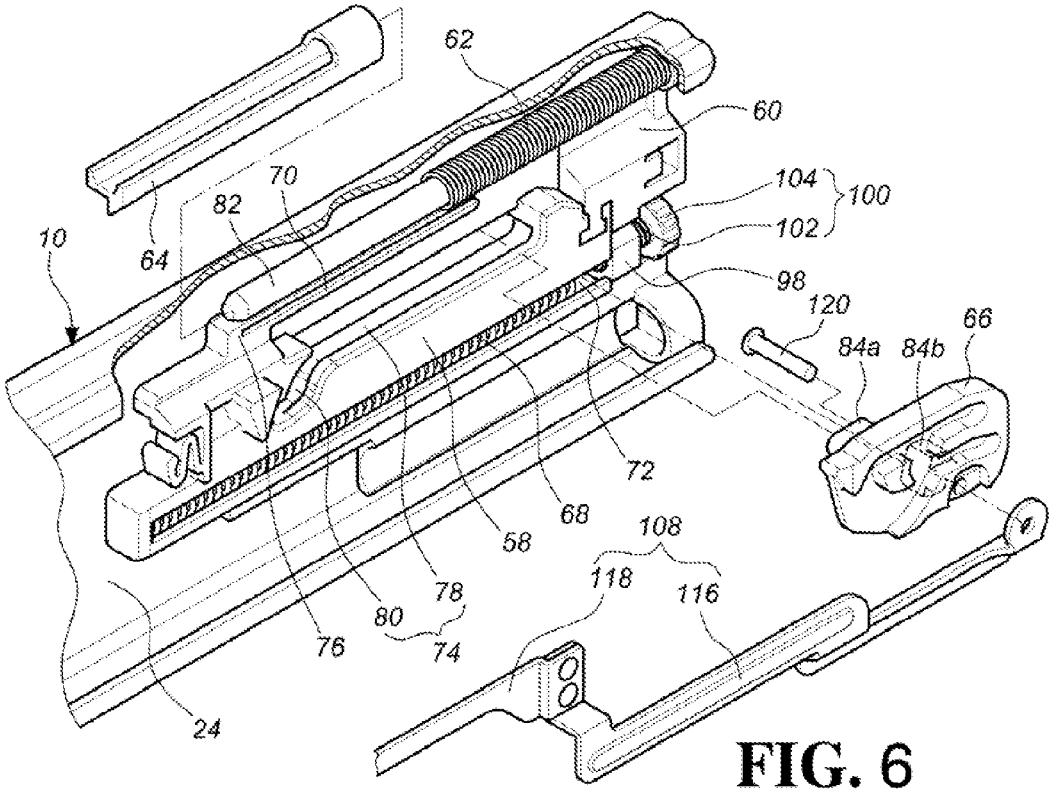
FIG. 6 is an exploded view to show part of the movable unit of the slide assembly of the present invention.

The movable unit 50, as shown in FIGS. 5 and 6, comprises a base 58, a fixing frame 60, a first resilient member 62, a push member 64, a movable member 66 and a second resilient member 68. The base 58 is connected to one end of the side wall 24 of the first rail 10 and comprises a longitudinal section 70, a room 72 and a guide passage 74. The distal end of the longitudinal section 70 has a stop portion 76. The room 72 is substantially parallel to the longitudinal section 70. The guide passage 74 has a longitudinal guide groove 78 and a transverse guide groove 80 which is located at the distal end of the longitudinal guide rove 78 and communicates with the longitudinal guide groove 78.

The fixing frame 60 is connected to the base 58 and comprises a longitudinal rod 82.

The first resilient member 62 is mounted to the longitudinal rod 82 and has one end thereof contacting the fixing frame 60.

The push member 64 is slidably connected to the longitudinal section 70 of the base 58 and movably mounted to the longitudinal rod 82 of the fixing frame 60 and contacts the first resilient member 62. When the push member 64 is pushed to compress the first resilient member 62, the first resilient member 62 generates a force in a first direction and the force is applied to the push member 64.

The movable member 66 is movably connected to the base 58 and has a first leg 84*a*, a second leg 84*b*, a guide path 86 and an engaging portion 88. The first leg 84*a* and the second leg 84*b* are respectively located corresponding to the guide passage 74 and the room 72 of the base 58. The initial status of the first leg 84*a* is contacting the longitudinal guide groove 78 of the guide passage 74 and the second leg 84*b* is located in the room 72 of the base 58. The guide path 86 has a first longitudinal guide path 90, a second longitudinal guide path 92 and a mediate path 94. The first and second longitudinal guide paths 90, 92 are located on two sides of the engaging portion 88. The mediate path 94 communicates with the first and second longitudinal guide paths 90, 92 and is located corresponding to the engaging portion 88. Preferably, the movable member 66 has a driving end 96 which is located close to the engaging portion 88.

The second resilient member 68 is located in the room 72 of the base 58. When the second leg 84*b* moves to compress the second resilient member 68, the second resilient member 68 is compressed by the second leg 84*b* and generates a force in a second direction. The force of the second resilient member 68 is applied to the second leg 84*b*. The first and second directions are in opposite to each other.

A preferable embodiment further comprises a threaded block 98 and an adjustment member 100 both located corresponding to the room 72. The adjustment member 100 has a threaded rod 102 and a head 104 which extends from one end of the threaded rod 102. The threaded rod 102 of the adjustment member 100 threadedly extends through the threaded block 98, so that the threaded rod 102 in the room 72 contacts the second leg 84*b* of the movable member 66. When the user rotates the head 104 of the adjustment member 100, the threaded rod 102 is moved forward or backward relative to the room 72 such that the initial position of the second leg 84*b* in the room 72 of the base 58 can be adjusted.

Figure 7:
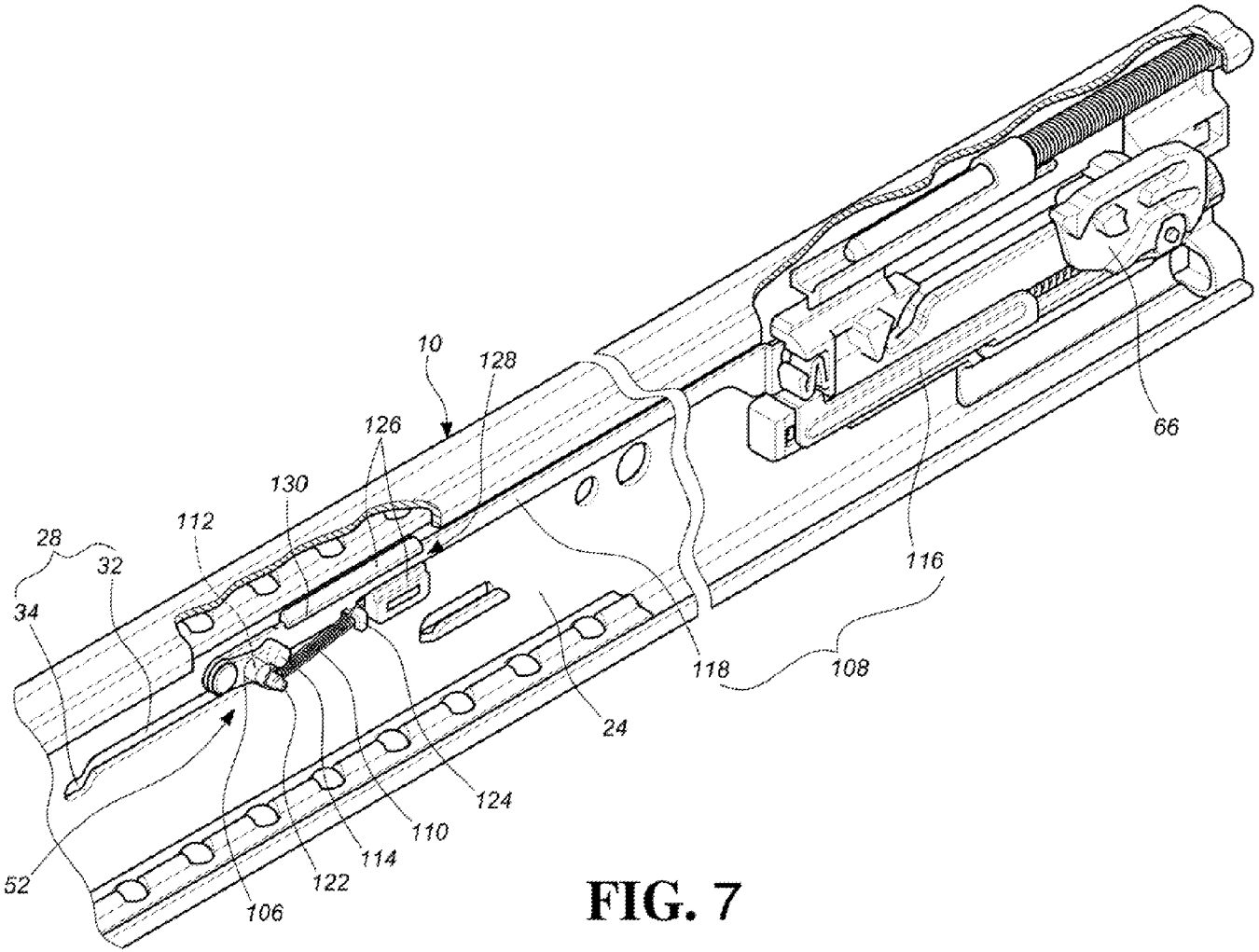
FIG. 7 is a perspective view to show the passive unit of the slide assembly of the present invention.

The passive unit 52, as shown in FIG. 7, has a link 106, a connection unit 108 and a first spring 110. The link 106 has a first protrusion 112 and a second protrusion 114. The first protrusion 112 is located in the guide groove 28 of the first rail 10. The second protrusion 114 is located longitudinally and corresponding to the protrusion 40 of the second rail 14. The connection unit 108 is connected between the movable member 66 and the link 106. In a preferable embodiment, the connection unit 108 comprises a first connector 116 and a second connector 118 which is connected to the first connector 116. The first connector 116 is fixed to the movable member 66 by a fixing member 120 as shown in FIG. 6. The second connector 118 is pivotably connected to the link 106. The first spring 110 is connected between the link 106 and the second connector 118 of the connection unit 108. In a preferable embodiment, the link 106 has a first hook 122 and the second connector 118 has a second hook 124. The first spring 110 is hooked between the first and second hooks 122, 124.

In a preferable embodiment, the movable unit 52 comprises a support member 126 fixed to the side wall 24 of the first rail 10 and has a support passage 128 in which the second connector 118 is movably located. The support member 126 has at least one stop wall 130 to maintain the second connector 118 in the support passage 128 of the support member 126.

The synchronic unit 54, as shown in FIG. 3, has a synchronic member 132 and a second spring 134. The synchronic member 132 is pivotably connected to the side wall 38 of the second rail 14 by a pivot 136 and has a first contact portion 138 and a second contact portion 140. The first contact portion 138 extends through the window 42 of the second rail 14 and toward the side wall 24 of the first rail 10. The first contact portion 138 of the synchronic member 132 has an inclined face 142 which is located corresponding to the release portion 26 of the first rail 10. The second contact portion 140 is located corresponding to the push block 46 of the third rail 18. The second spring 134 is connected between the synchronic member 132 and the second rail 14. In a preferable embodiment, the synchronic member 132 has a third hook 144 and the second rail 14 has a fourth hook 146. The second spring 134 is hooked between the third and fourth hooks 144, 146.

The hooking unit 56, as shown in FIG. 4, has a hooking member 148, a cover 150 and a contact member 152. The hooking member 148 is pivotably connected to the cover 150 by a pin 156. The cover 150 is securely connected to the third rail 18 and located corresponding to the opening 48 of the third rail 18. The cover 150 has a curved slot 158 which is located corresponding to the hooking portion 154 of the hooking member 148. The hooking portion 154 of the hooking member 148 extends through the curved slot 158 and is movable within the curved slot 158. The contact member 152 is fixed to the third rail 18 and located corresponding to the driving end 96 of the movable member 66.

Figure 8:
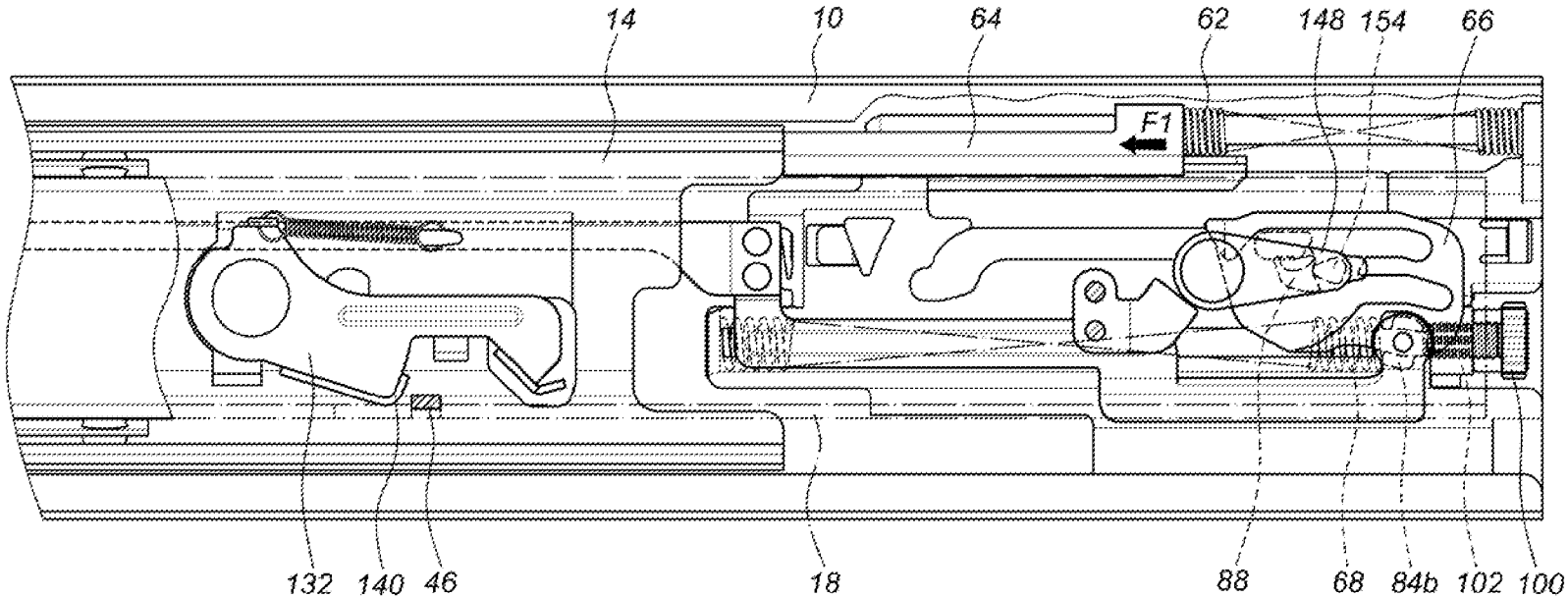
FIG. 8 is a perspective view to show that the slide assembly of the present invention is completely retracted.

As shown in FIG. 8, when the third rail 18 is located at a retracted position relative to the first rail 10, the second rail 14 is retracted in the first rail 10. The hooking portion 154 of the hooking member 148 is engaged with the engaging portion 88 of the movable member 66. The second resilient member 68 contacts the second leg 84*b* of the movable member 66. The push member 64 is pushed by the second rail 14 and compresses the first resilient member 62, the first resilient member 62 generates a force in a first direction F1 and the force is applied to the push member 64. Under the retracted status, the push block 46 of the third rail 18 is located corresponding to the second contact portion 140 of the synchronic member 132 of the second rail 14. The first resilient member 62 stores a force relative to the second rail 14. The force of the second resilient member 68 is applied to the movable member 66. The second leg 84*b* of the movable member 66 contacts the threaded rod 102 of the adjustment member 100.

Figure 9:
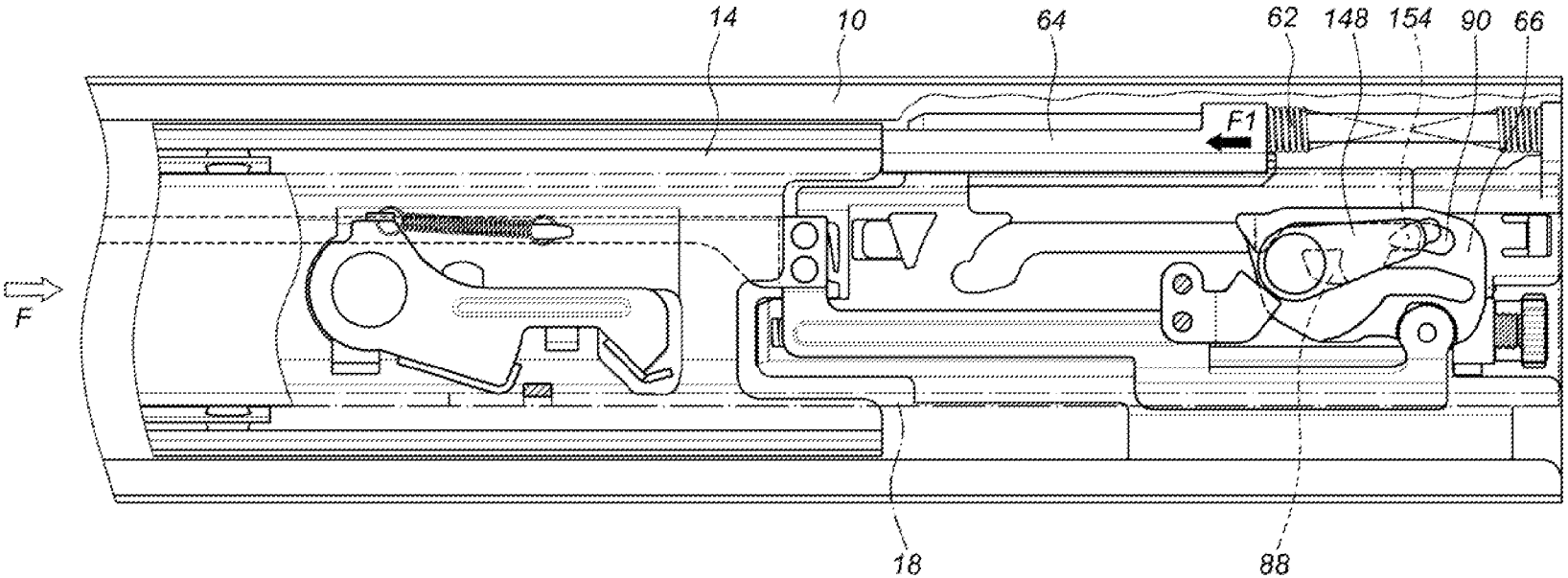
FIG. 9 shows the slide assembly of the present invention wherein the third rail is pushed.
Figure 10:
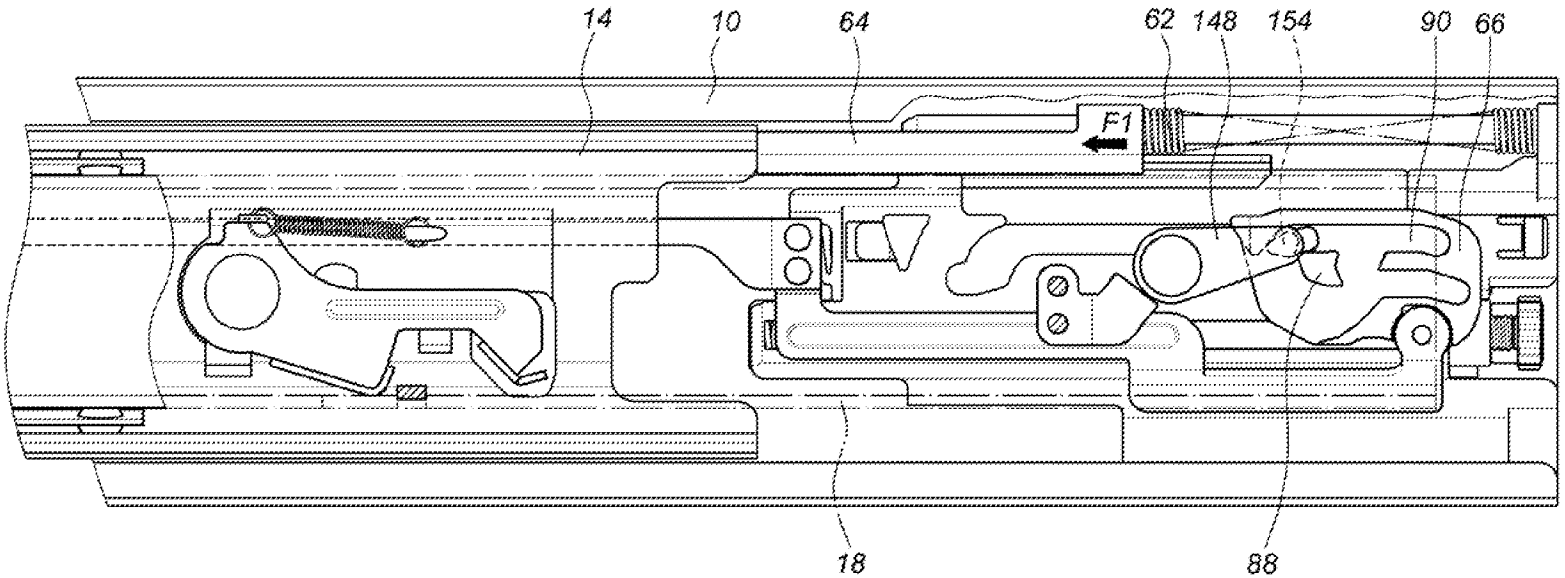
FIG. 10 shows the slide assembly of the present invention wherein the third rail is pushed and then released.

As shown in FIG. 9, when the third rail 18 is pushed by a pushing force F (as shown in the direction shown by the arrow head), the hooking portion 154 of the hooking member 148 is disengaged from the engaging portion 88 of the movable member 66 and is moved to the first longitudinal guide path 90 of the movable member 66. When the pushing force is disappeared, the force in the first direction F1 of the first resilient member 62 is released, as shown in FIGS. 10 and 11, the second rail 14 is pushed by the push member 64 and the third rail 18 is also moved by the second rail 14 relative to the first rail 10.

Figure 11:
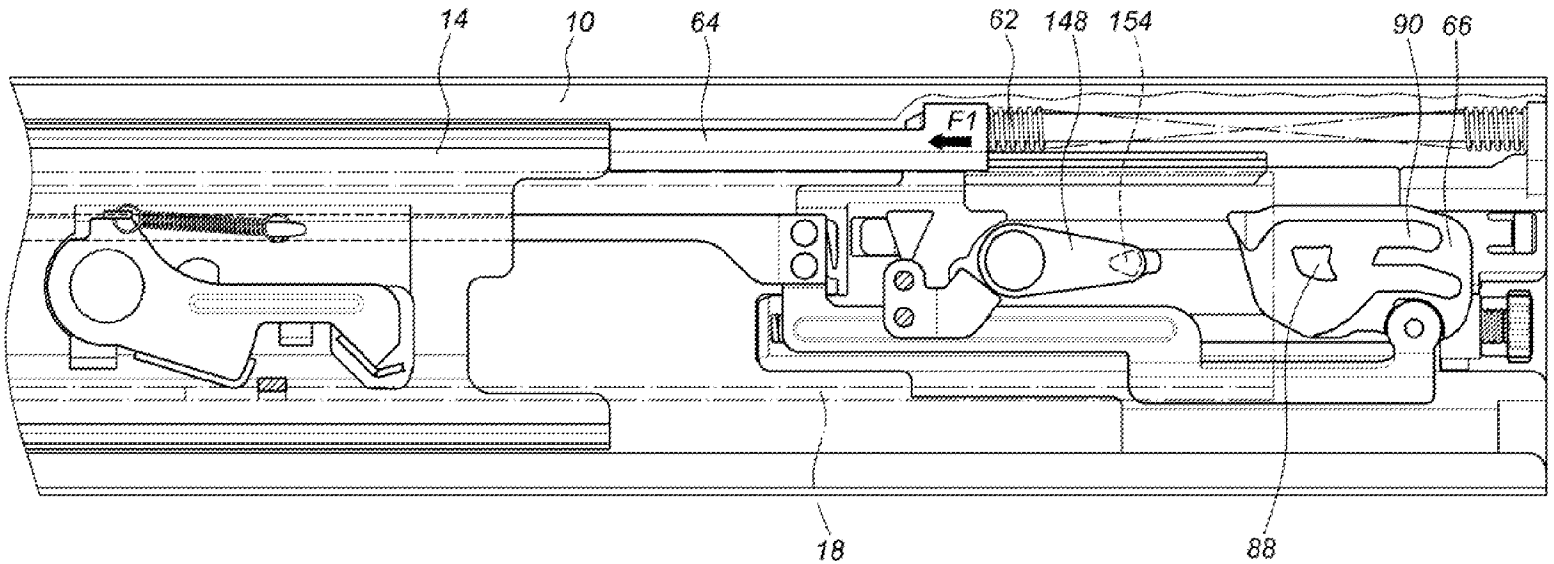
FIG. 11 shows another status of the slide assembly of the present invention wherein the third rail is pushed and then released.
Figure 12:
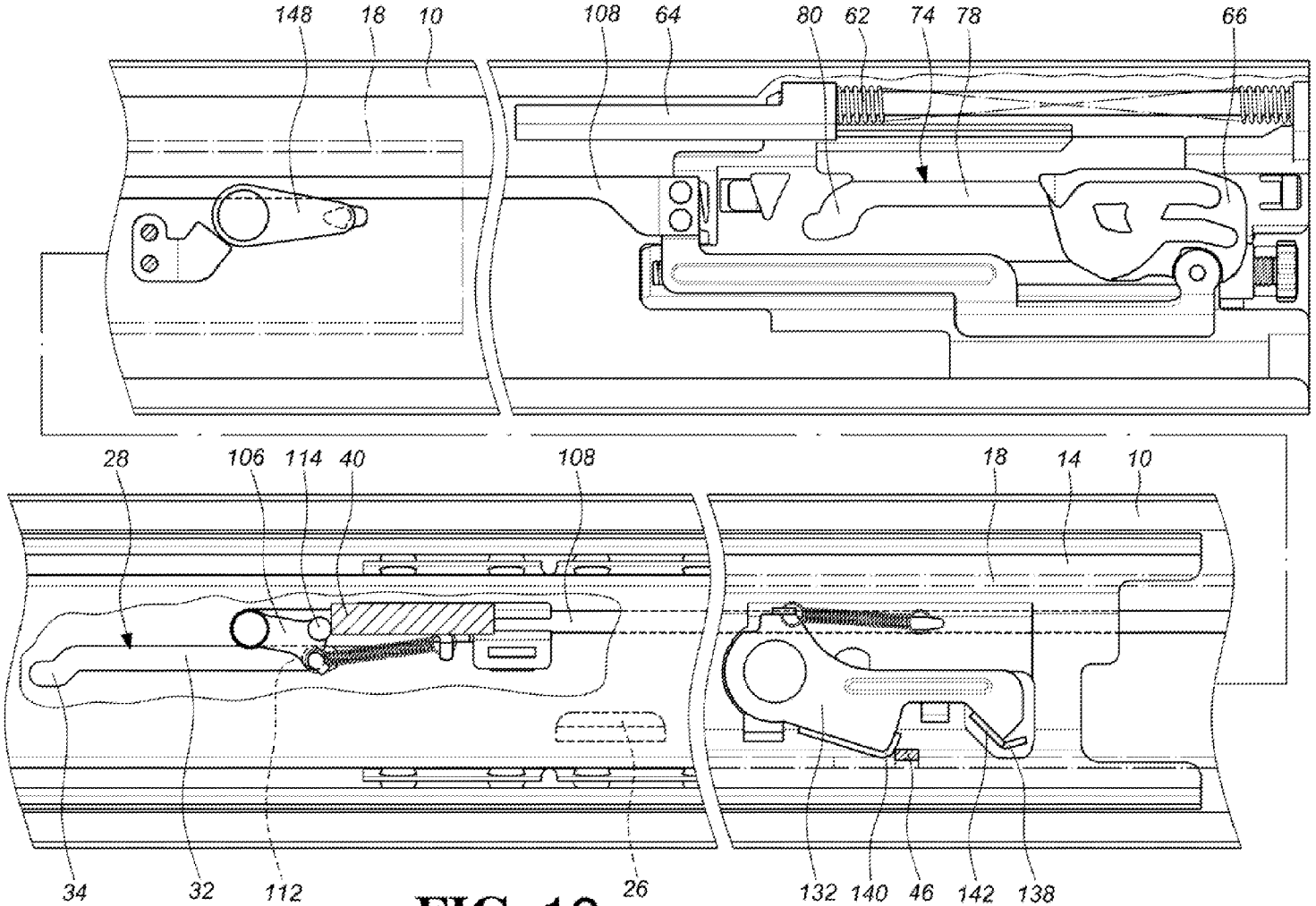
FIG. 12 shows that the third rail is pushed and then pulled, and the second rail is also pulled with the third rail.
Figure 13:
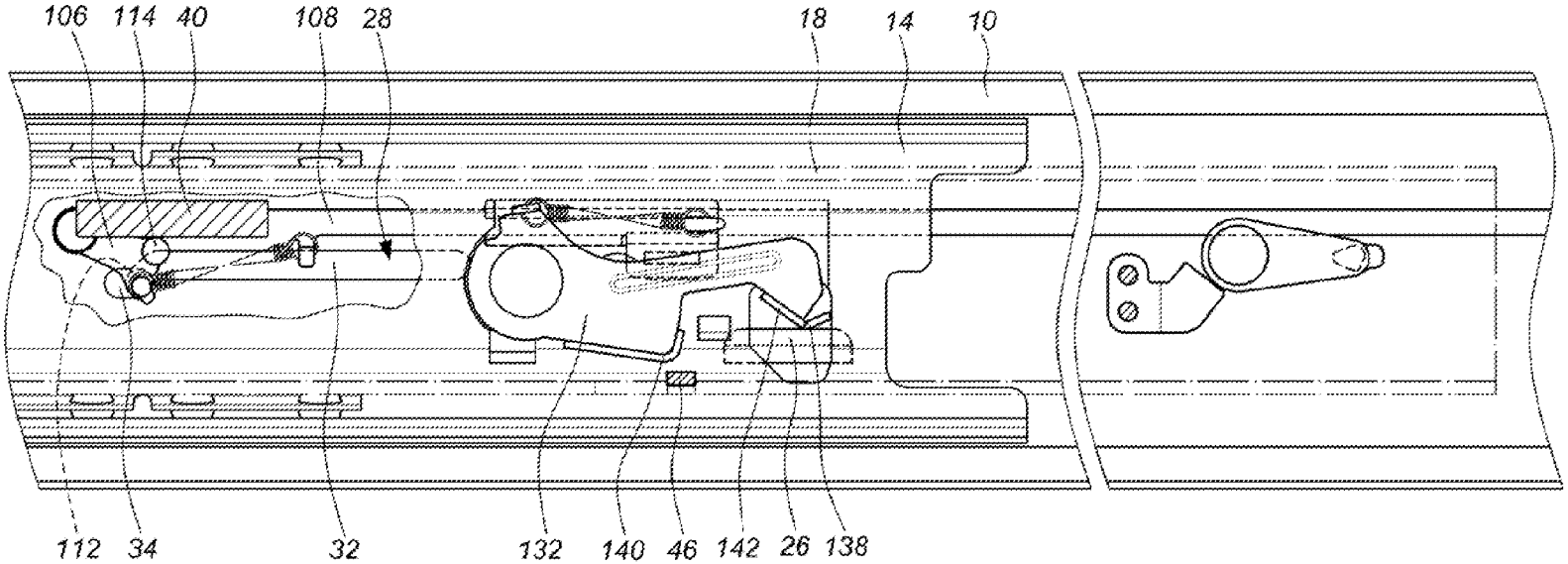
FIG. 13 shows that the third rail is pushed and then pulled, and the second rail is also pulled with the third rail, the passive unit and the synchronic unit are activated.
Figure 14:
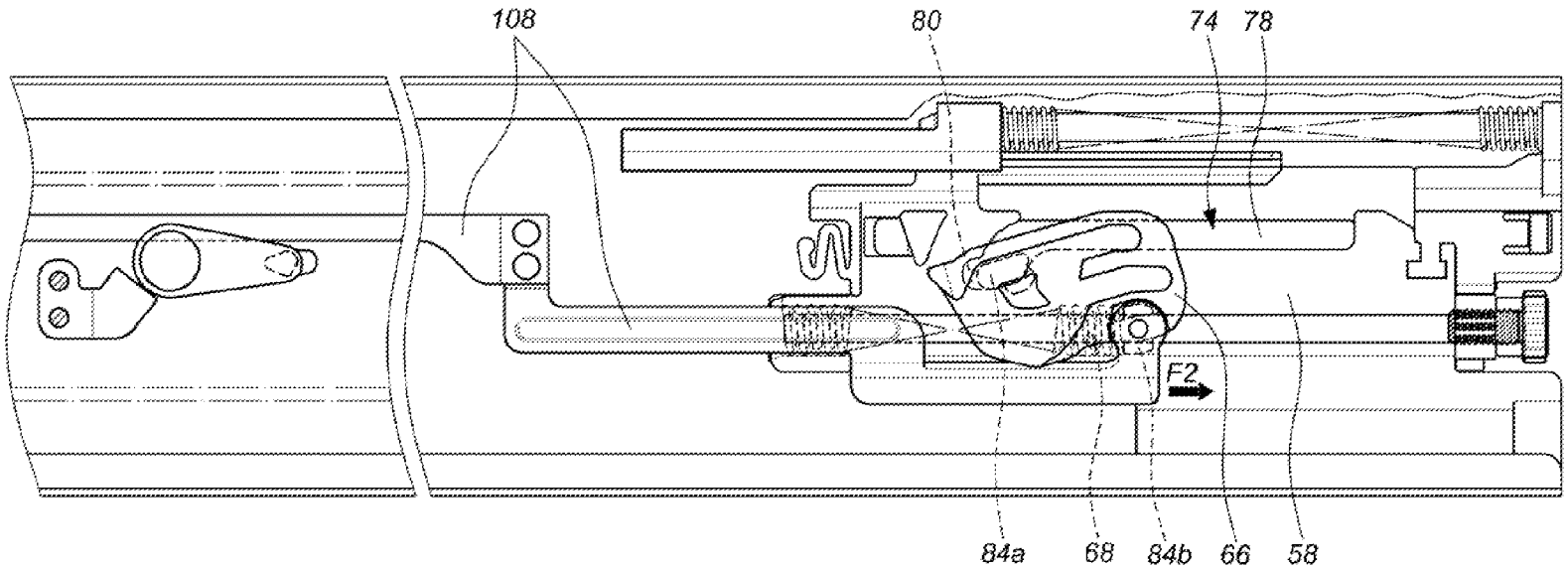
FIG. 14 shows that the third rail is pushed and then pulled, and the second rail is also pulled with the third rail, the movable member of the passive unit is activated.

As shown in FIG. 11, when the third rail 18 is continuously pulled relative to the first rail 10, as shown in FIGS. 12 and 13, the push block 46 of the third rail 18 contacts the second contact portion 140 of the synchronic member 132 so that the second rail 14 is pulled along with the movement of the third rail 18. The protrusion 40 of the second rail 14 pushes the second protrusion 114 of the link 106 so that along with the continuous movement of the second rail 14, the first protrusion 112 of the link 106 moves along the longitudinal groove 32 of the guide groove 28 of the first rail 10. As shown in FIGS. 13 and 14, the connection unit 108 is connected between the movable member 66 is moved by the link 106, the movable member 66 moves along the longitudinal guide groove 78 of the guide passage 74 of the base 58. When the first protrusion 112 is guided and engaged with the transverse groove 34 of the guide groove 28, the protrusion 40 of the second rail 14 presses on the top of the second protrusion 114 of the link 106. The first protrusion 112 of the link 106 is located in the transverse groove 34 of the guide groove 28. The movable member 66 is guided and moved, the first leg 84*a* is located in the transverse guide groove 80 of the guide passage 74 and the second resilient member 68 is compressed by the second leg 84*b* and generates a force in the second direction F2.

As shown in FIG. 13, when the first contact portion 138 of the synchronic member 132 contacts the release portion 26 of the first rail 10, the first contact portion 138 contacts the release portion 26 by the inclined face 142 and is temporarily positioned. The synchronic member 132 swings an angle and the second contact portion 140 of the synchronic member 132 is disengaged from the push block 46 of the third rail 18. Therefore, the third rail 18 can be completely pulled relative to the first rail 10 and the distance is prolonged by the second rail 14.

Figure 15:
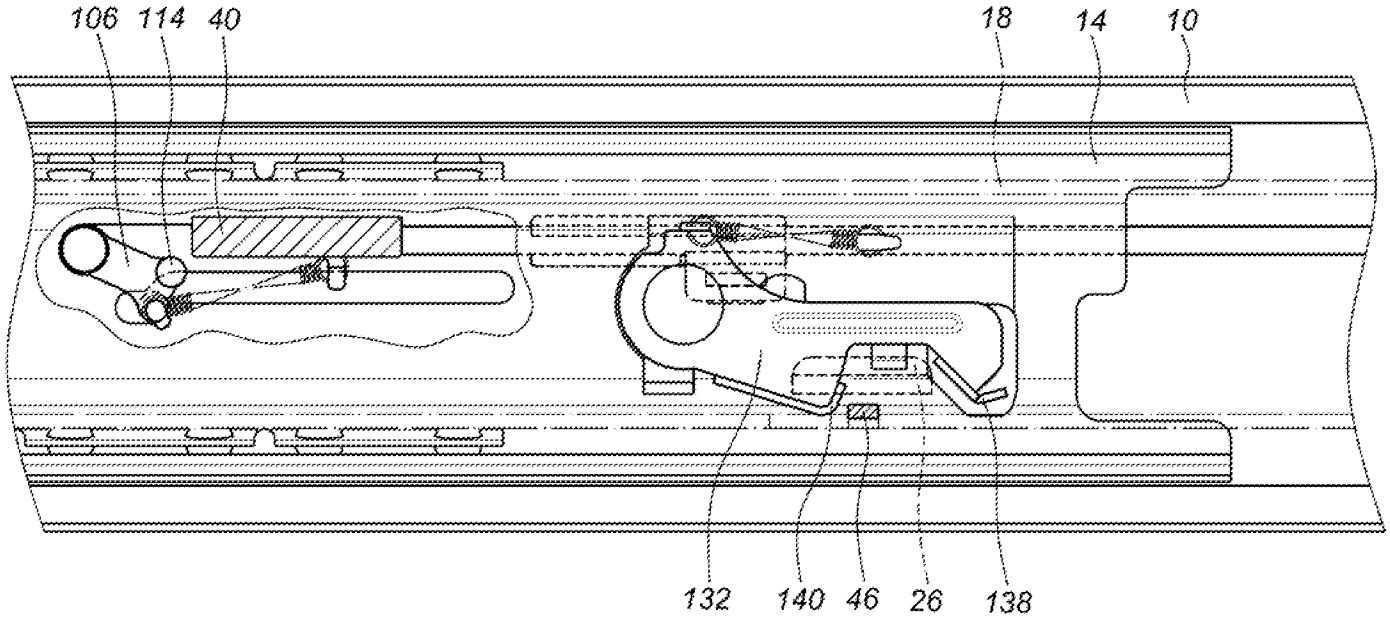
FIG. 15 shows the two respective statuses of the passive unit and the synchronic unit when the third and second rails are pushed and retracted into the first rail.

As shown in FIG. 15, when the third rail 18 is retracted relative to the first rail 10, the third rail 18 is first retracted into the second rail 14, and then the third rail 18 and the second rail 14 are retracted relative to the first rail 10. The push block 46 of the third rail 18 moves to the position where the push block 46 is located corresponding to the second contact portion 140 of the synchronic member 132. The first contact portion 138 of the synchronic member 132 is separated from the release portion 26 of the first rail 10. The protrusion 40 of the second rail 14 does not press on the second protrusion 114 of the link 106 after the second rail 14 moves.

Figure 16:
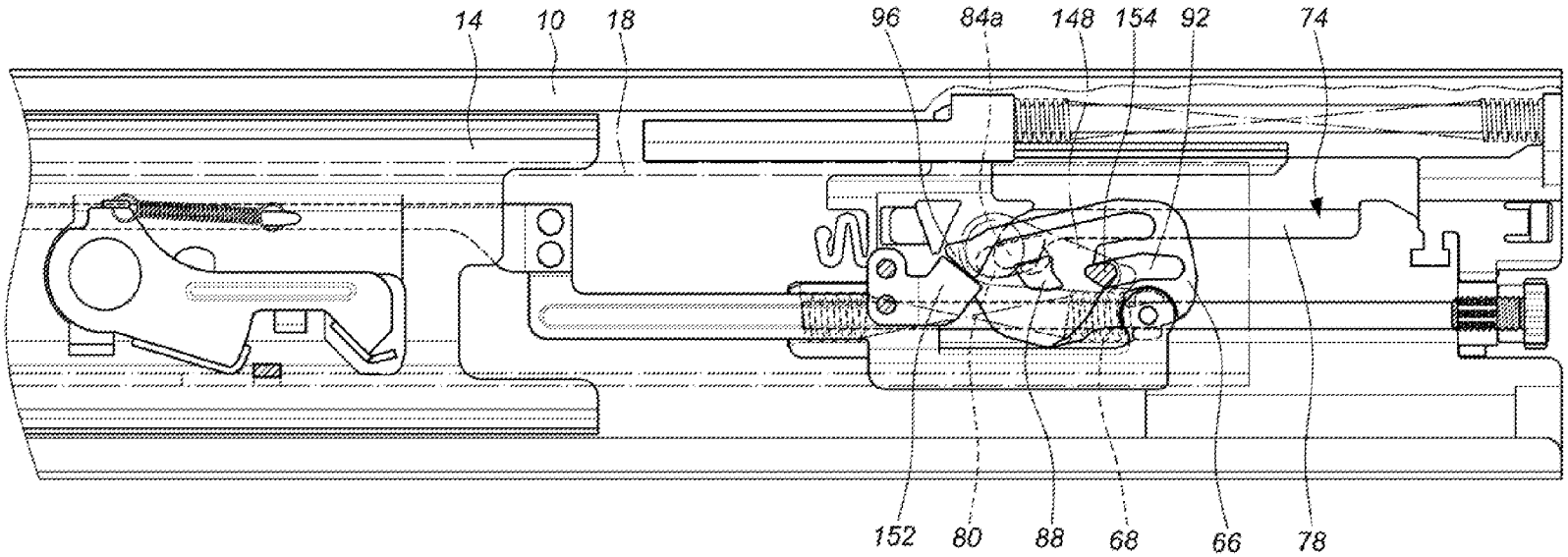
FIG. 16 shows the status of the movable unit when the third and second rails are pushed and retracted into the first rail.
Figure 17:
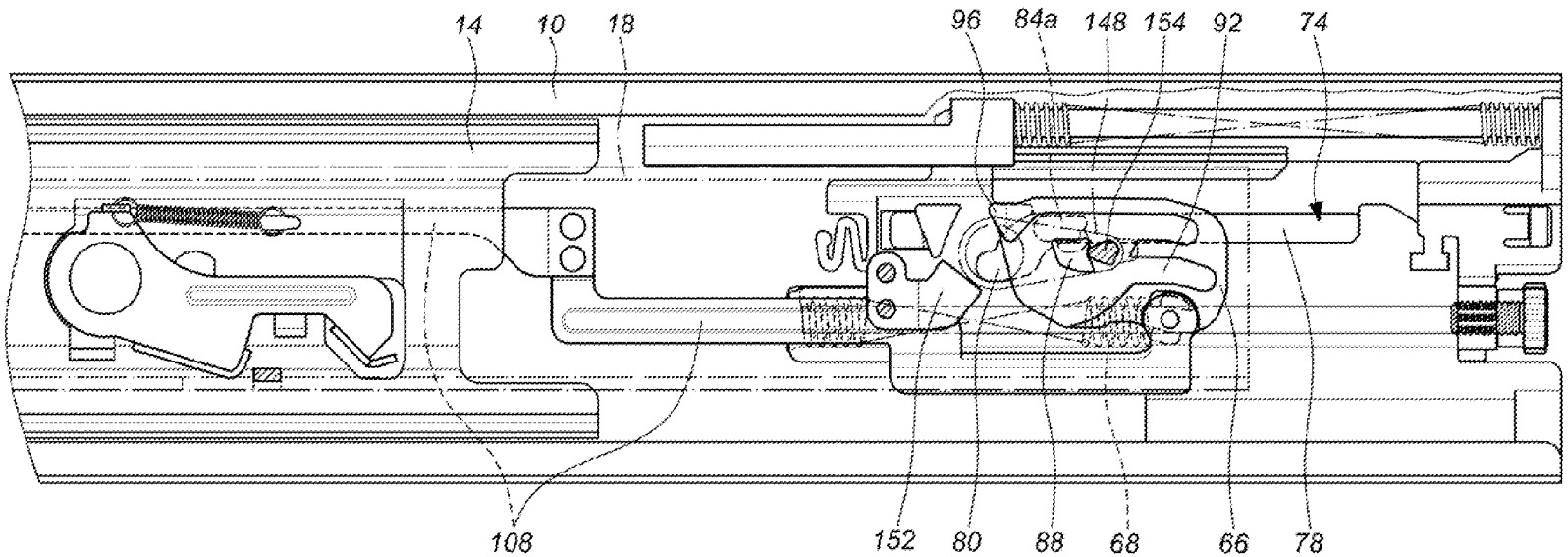
FIG. 17 shows that the movable member of the movable unit is pushed back to its initial position by the contact member when the third and second rails are pushed and retracted into the first rail.

As shown in FIGS. 16 and 17, when the second and third rails 14, 18 are retracted relative to the first rail 10, and the contact member 152 pushes the driving end 96 of the movable member 66 so that the first leg 84*a* of the movable member 66 is disengaged from the transverse guide groove 80 of the guide passage 74 and the hooking portion 154 of the hooking member 148 is moved to the second longitudinal guide path 92 of the movable member 66 and contacts the engaging portion 88 of the movable member 66. The force of the second resilient member 68 in the second direction F2 is applied to the movable member 66, the engaging portion 88 of the movable member 66 contacts the hooking portion 154 of the hooking member 148 to retract the third rail 18 relative to the first rail 10 to the status as shown in FIG. 8.

Figure 18:
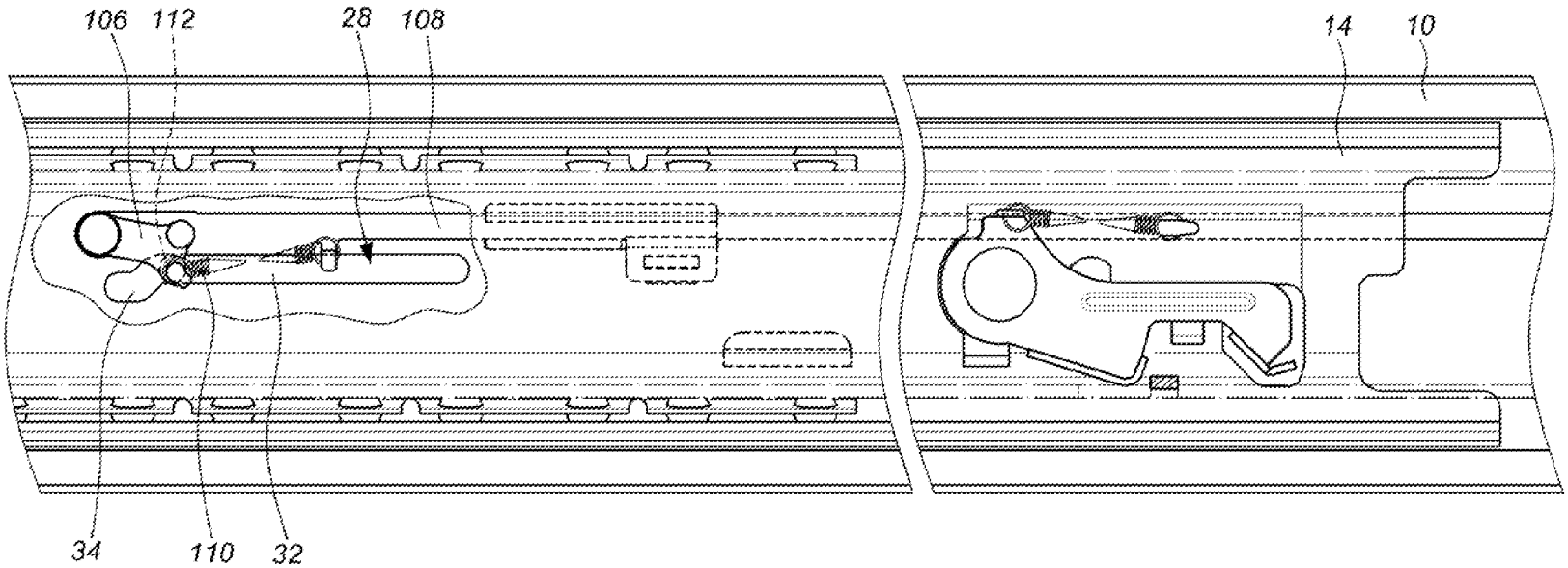
FIG. 18 shows that the link of the passive unit is pushed back to its initial position when the third and second rails are pushed and retracted into the first rail.

Alternatively, as shown in FIG. 17, a connection unit 108 is connected to the movable member 66 and the link 106 so that the movable member 66 moves the link 106 as shown in FIG. 18. The first protrusion 112 of the movable member 66 removes from the transverse groove 34 of the guide groove 28 and returns to the longitudinal groove 32 of the guide groove 28. The first spring 110 provides assistance to allow the link 106 to swing smoothly.

Figure 19:
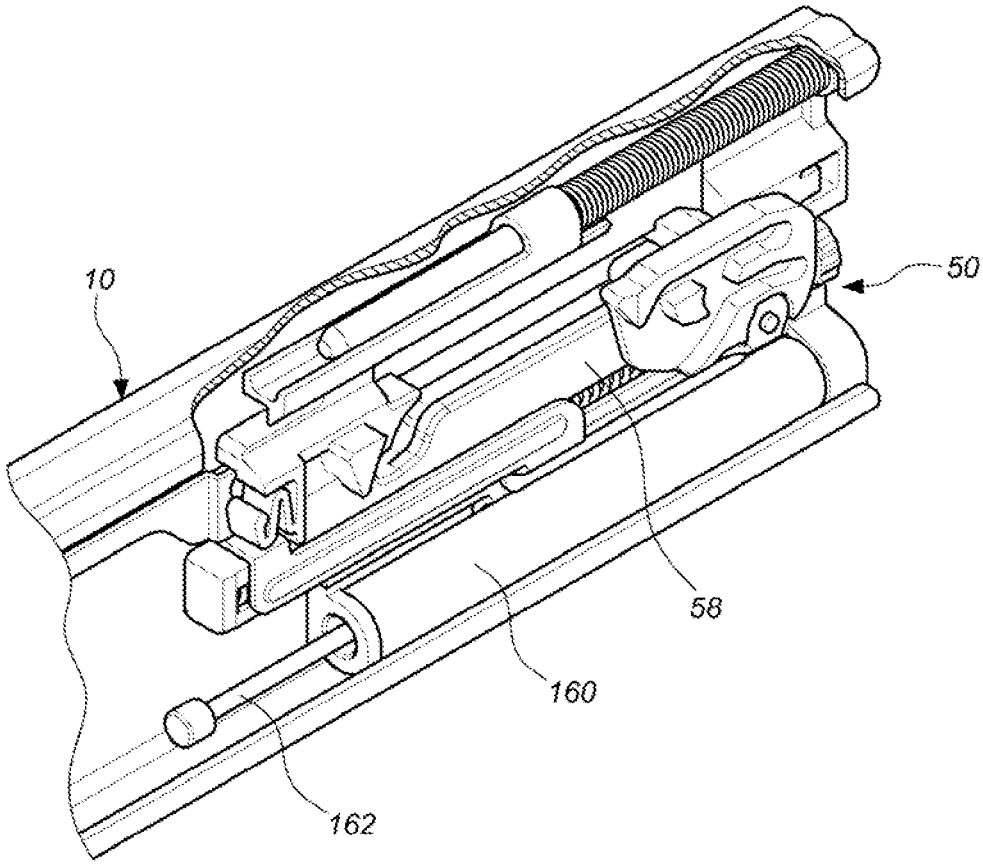
FIG. 19 shows that the slide assembly of the present invention has a buffering member.
Figure 20:
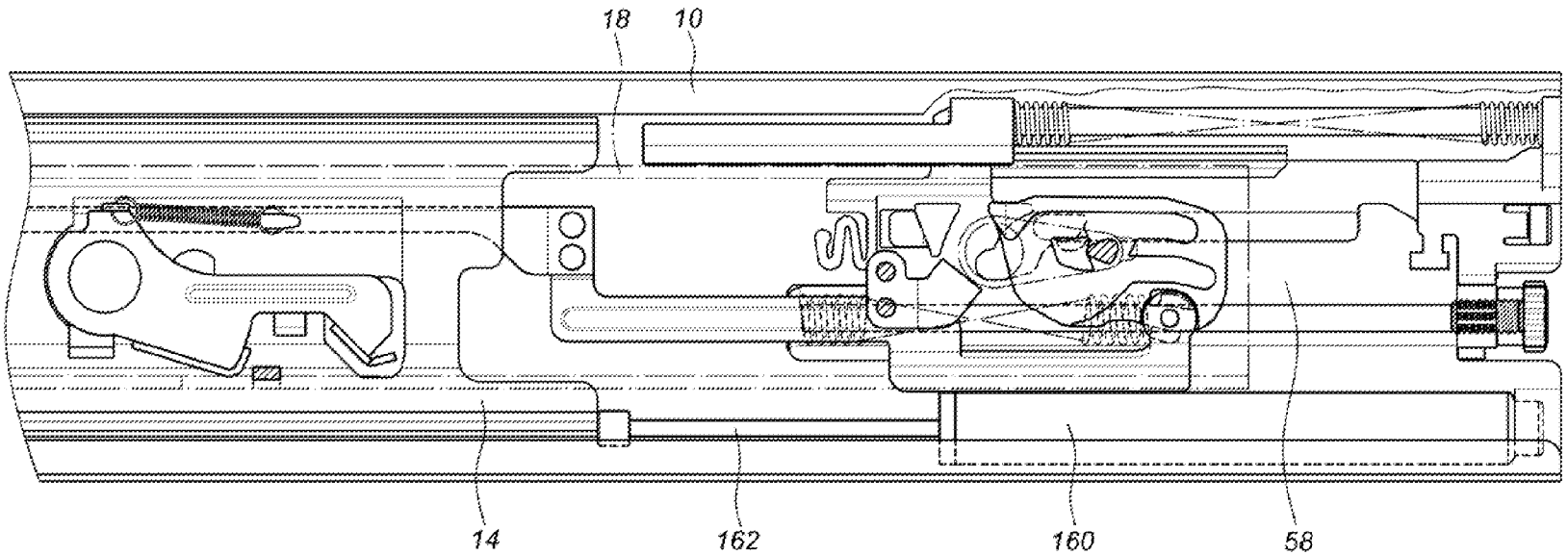
FIG. 20 shows that the buffering member is functioned to the second rail.

As shown in FIGS. 19, 20, a preferable embodiment further comprises a buffering member 160 connected to the first rail 10 and comprises a plunger 162 which is extendable from the buffering member 160. The plunger 162 is located corresponding to the second rail 14 and the distance that the plunger 162 extends forms a buffering travel to the second rail 14. When the second rail 14 is retracted with the third rail 18 relative to the first rail 10, the plunger 162 contacts the second rail 14 so that the retraction action of the slide assembly is more stable.

While we have shown and described the embodiment in accordance with the present invention, it should be clear to those skilled in the art that further embodiments may be made without departing from the scope of the present invention.

What is claimed is:

1. A self-opening and self-closing slide assembly comprising:

a first rail having a side wall, a release portion, a guide groove and a first passage, the release portion located on the side wall and in the first passage, the guide groove located on the side wall and having a longitudinal groove and a transverse groove which communicates with the longitudinal groove;

a second rail slidably connected to the first rail and having a side wall, a protrusion and a second passage, the protrusion connected to the side wall of the second rail and facing the first passage of the first rail;

a third rail slidably connected to the second rail and having a push block facing the second passage of the second rail;

a movable unit having a base, a first resilient member, a push member, a movable member and a second resilient member, the base connected to the side wall of the first rail and having a longitudinal section, a room and a guide passage, the room substantially parallel to the longitudinal section, the guide passage having a longitudinal guide groove and a transverse guide groove which communicates with the longitudinal guide groove, the first resilient member being biased between the base and the push member, the push member located corresponding to the second rail, the movable member movably connected to the base and having a first leg, a second leg, a guide path and an engaging portion, the first leg and the second leg respectively located corresponding to the guide passage and the room of the base, the guide path having a first longitudinal guide path, a second longitudinal guide path and a mediate path, the first and second longitudinal guide paths located on two sides of the engaging portion, the mediate path communicating with the first and second longitudinal guide paths and located corresponding to the engaging portion, the second resilient member located in the room of the base and contacting the second leg of the movable member;

a passive unit having a link, a connection unit and a first spring, the link having a first protrusion and a second protrusion, the first protrusion located in the guide groove of the first rail, the second protrusion located corresponding to the protrusion of the second rail, the connection unit connected between the movable member and the link, the first spring connected between the link and the connection unit;

a synchronic unit having a synchronic member and a second spring, the synchronic member pivotably connected to the second rail and having a first contact portion and a second contact portion, the first contact portion facing the side wall of the first rail and located corresponding to the release portion, the second contact portion located corresponding to the push block of the third rail, the second spring connected between the synchronic member and the second rail;

a hooking unit having a hooking member and a contact member, the hooking member pivotably connected to the third rail and having a hooking portion, the contact member fixed to the third rail and located corresponding to the movable member;

when the third rail is located at a retracted position relative to the first rail, the second rail is retracted in the first rail, the hooking portion of the hooking member is engaged with the engaging portion of the movable member, the push member is pushed by the second rail and compresses the first resilient member, the first resilient member generates a force in a first direction and the force is applied to the push member, the second leg of the movable member contacts the second resilient member, the push block of the third rail is located corresponding to the second contact portion of the synchronic member;

wherein, when the third rail is pushed by a pushing force, the hooking portion of the hooking member is disengaged from the engaging portion of the movable member and is moved to the first longitudinal guide path of the movable member, when the pushing force is disappeared, the force in the first direction of the first resilient member is released, the second rail is pushed by the push member and moves relative to the first rail, when the third rail is continuously pulled, the push block of the third rail contacts the second contact portion of the synchronic member so that the second rail is pulled along with movement of the third rail, the protrusion of the second rail pushes the second protrusion of the link so that the first protrusion of the link moves along the longitudinal groove of the guide groove of the first rail, the movable member is moved by the link and the connection unit, the movable member moves along the longitudinal guide groove of the guide passage of the base, when the first protrusion is engaged with the transverse groove of the guide groove, the protrusion of the second rail presses on a top of the second protrusion of the link, the first leg is located in the transverse guide groove of the guide passage and the second resilient member is compressed by the second leg and generates a force in a second direction, when the first contact portion of the synchronic member contacts the release portion of the first rail, the synchronic member swings an angle and the second contact portion of the synchronic member is disengaged from the push block of the third rail, and wherein, when the third rail is retracted relative to the first rail, the first contact portion of the synchronic member is separated from the release portion of the first rail and the second contact portion returns to a position located corresponding to the push block, when the contact member pushes the movable member, the movable member is disengaged from the transverse guide groove of the guide passage and the hooking portion of the hooking member contacts the engaging portion of the movable member, the force of the second resilient member retracts the third rail relative to the first rail and the first protrusion of the link is separated from the transverse groove of the guide groove.

2. The slide assembly as claimed in claim 1 further comprising a threaded block and an adjustment member both located corresponding to the room, the adjustment member having a threaded rod and a head which extends from an end of the threaded rod, the threaded rod of the adjustment member threadedly extending through the threaded block, the threaded rod in the room contacting the second leg of the movable member.

3. The slide assembly as claimed in claim 1, wherein the connection unit comprises a first connector and a second connector which is connected to the first connector, the first connector is fixed to the movable member by a fixing member, the second connector is pivotably connected to the link.

4. The slide assembly as claimed in claim 3, wherein the link has a first hook and the second connector has a second hook, the first spring is hooked between the first and second hooks.

5. The slide assembly as claimed in claim 3, wherein a support member is fixed to the side wall of the first rail and has a support passage in which the second connector is movably located, the support member has at least one stop wall to maintain the second connector in the support passage.

6. The slide assembly as claimed in claim 1, wherein the side wall of the second rail has a window and the synchronic member is located beside the window and pivotably connected to the second rail by a pivot, the first contact portion of the synchronic member extends through the window and toward the side wall of the first rail.

7. The slide assembly as claimed in claim 6, wherein the first contact portion of the synchronic member has an inclined face which is located corresponding to the release portion of the first rail, the synchronic member has a third hook and the second rail has a fourth hook, the second spring is hooked between the third and fourth hooks.

8. The slide assembly as claimed in claim 1, wherein the third rail has an opening, the hooking unit comprises a cover which is located corresponding to the opening is fixed to the third rail, the hooking member is pivotably connected to the cover by a pin, the cover has a curved slot which is located corresponding to the hooking portion of the hooking member, the hooking portion of the hooking member extends through the curved slot.

9. The slide assembly as claimed in claim 1, wherein a buffering member is connected to the first rail and comprises a plunger which is extendable from the buffering member, a distance that the plunger extends forms a buffering travel to the second rail.

10. A self-opening and self-closing slide assembly comprising:

a first rail having a top wall, bottom wall, a side wall, a release portion and a guide groove, the side wall connected between the top and bottom walls, the top wall, the bottom wall and the side wall defining a first passage, the release portion located on the side wall and in the first passage, the guide groove located on the side wall and having a longitudinal groove and a transverse groove which is located at a distal end of the longitudinal groove and communicates with the longitudinal groove;

a second rail slidably connected to the first rail and having a top wall, a bottom wall, a side wall and a protrusion, the side wall connected between the top and bottom walls of the second rail, the top wall, the bottom wall and the side wall defining a second passage, the protrusion connected to the side wall of the second rail and facing the first passage of the first rail;

a third rail slidably connected to the second rail and having a push block facing the second passage of the second rail;

a movable unit having a base, a fixing frame, a first resilient member, a push member, a movable member and a second resilient member, the base connected to the side wall of the first rail and having a longitudinal section, a room and a guide passage, the room substantially parallel to the longitudinal section, the guide passage having a longitudinal guide groove and a transverse guide groove which is located, at a distal end of the longitudinal guide rove and communicates with the longitudinal guide groove, the fixing frame is connected to the base and comprising a longitudinal rod, the first resilient member mounted to the longitudinal rod, the push member slidably connected to the longitudinal section of the base and movably mounted to the longitudinal rod of the fixing frame and contacting the first resilient member, the movable member movably connected to the base and having a first leg, a second leg, a guide path and an engaging portion, the first leg and the second leg respectively located corresponding to the guide passage and the room of the base, the guide path having a first longitudinal guide path, a second longitudinal guide path and a mediate path, the first and second longitudinal guide paths located on two sides of the engaging portion, the mediate path communicating with the first and second longitudinal guide paths and located corresponding to the engaging portion, the second resilient member located in the room of the base and contacting the second leg of the movable member;

a passive unit having a link, a connection unit and a first spring, the link having a first protrusion and a second protrusion, the first protrusion located in the guide groove of the first rail, the second protrusion located corresponding to the protrusion of the second rail, the connection unit connected between the movable member and the link, the first spring connected between the link and the connection unit;

a synchronic unit having a synchronic member and a second spring, the synchronic member pivotably connected to the second rail and having a first contact portion and a second contact portion, the first contact portion facing the side wall of the first rail and located corresponding to the release portion, the second contact portion located corresponding to the push block of the third rail, the second spring connected between the synchronic member and the second rail, and a hooking unit having a hooking member and a contact member, the hooking member pivotably connected to the third rail and having a hooking portion, the contact member fixed to the third rail and located corresponding to the movable member.

* * * * *